US007305724B2

(12) United States Patent
Rozental et al.

(10) Patent No.: US 7,305,724 B2
(45) Date of Patent: Dec. 11, 2007

(54) STOWABLE BABY BATHINETTE

(75) Inventors: Arkadiy I. Rozental, Owings Mills, MD (US); Mikhail Ruvinskiy, Owings Mills, MD (US); James E. Fay, Neenah, WI (US)

(73) Assignee: Baby Wize, LLC, Owings Mills, MD (US)

( * ) Notice: Subject to any disclaimer, the term of this patent is extended or adjusted under 35 U.S.C. 154(b) by 365 days.

(21) Appl. No.: 10/887,384

(22) Filed: Jul. 8, 2004

(65) Prior Publication Data

US 2005/0044628 A1 Mar. 3, 2005

Related U.S. Application Data

(60) Provisional application No. 60/485,213, filed on Jul. 8, 2003.

(51) Int. Cl.
*E03C 1/01* (2006.01)

(52) U.S. Cl. ..... 4/665; 4/572.1

(58) Field of Classification Search ..... 4/254, 4/340, 341, 342, 420.3, 445, 550, 551, 554, 4/572.1, 659, 664, 665; 5/655
See application file for complete search history.

(56) References Cited

U.S. PATENT DOCUMENTS 249,601 A * 11/1881 Egbert ..... 4/665 X
2,715,736 A 8/1955 Pearlson ..... 4/551
3,094,711 A 6/1963 Kentes ..... 4/550
5,067,186 A 11/1991 Ayers ..... 4/665
5,599,063 A * 2/1997 Lister et al. ..... 5/655 X
5,636,391 A 6/1997 Greene, III ..... 4/420.3
5,687,431 A * 11/1997 Garrett ..... 4/254

* cited by examiner

*Primary Examiner*—Robert M. Fetsuga
(74) *Attorney, Agent, or Firm*—Obler / Kaler; Royal W. Craig

(57) ABSTRACT

A baby changing, cleansing and bathing station with a basin hinged at the rear to pivot away from the wall overtop an existing toilet, a shower wand with adapter for connection to an existing faucet or shower, a front leg assembly for automatically deploying upon pivoting down of the basin, and a fold-down drain for automatically deploying upon pivoting down of the basin to drain water from the basin into said toilet. The automatic legs and drain allow for easy one-hand deployment while carrying a baby. The baby changing, cleansing and bathing station is adaptable to a freestanding configuration with either a cabinet enclosure or rear leg assembly for freestanding support, or a wall-mounted configuration with or without a cabinet enclosure.

22 Claims, 11 Drawing Sheets

Spring presses legs/drain against bed body

Weight eventually overpowers spring

Spring snaps leg / drain into lower position. Avoids loose dangling of parts

STOWABLE BABY BATHINETTE

CROSS-REFERENCE TO RELATED APPLICATIONS

The present application derives priority from U.S. Provisional Patent Application No. 60/485,213, filed: Jul. 8, 2003.

BACKGROUND OF THE INVENTION

1. Field of the Invention

The present invention relates generally to baby bathinettes, and more particularly, to a durable, convenient, sanitary, practical and safe baby changing, cleansing and bathing station that integrates with a conventional toilet, folds for storage above the toilet, and can be readily deployed for use as a diaper changing table/baby bidet/bath for safe, sanitary and convenient changing, cleansing or bathing of a baby.

2. Description of the Background

Simple fold-down baby changing stations have become a fixture in many public bathrooms thanks to their convenience, and more comprehensive cleansing stations are gaining widespread acceptance. For example, there are numerous prior art baby baths that are portable, or attach to sinks or tubs.

For example, U.S. Pat. No. 2,715,736 to Pearlson, as well as U.S. Pat. No. 3,094,711 to Kentes both show fairly similar fold-down wash basins. However, there is even greater utility in devices which drain into toilets for flushing afterward, and neither make such provision.

U.S. Pat. No. 5,636,391 to Greene III issued Jun. 10, 1997 shows a baby bidet adapted to be placed on the top of the rim of a toilet bowl, the bidet being shaped so as to fit within and on the toilet bowl. Unfortunately the device provides neither a comfortable working height for a caregiver nor means to change or bathe an infant. Moreover, the device tends to interfere with the conventional use of the toilet and has no life past the time a baby grows out of diapers.

U.S. Pat. No. 5,067,186 to Ayers issued Nov. 26, 1991 shows a baby bidet apparatus that does not interfere with the conventional use of the toilet, and can be readily positioned for application as a baby bidet or bath. The device includes a fold-down support which elevates the child above the toilet and drains the soiled water into the toilet. While conceptually good, the implementation of this device is less than safe as the entire load of the storage console, basin and baby is borne at a single point, and the design is prone to wobbling and other instabilities. Furthermore, the frame that straddles the toilet represents a serious tripping and foot injury hazards. There are also convenience as well as sanitary issues involved with the perforated drain platform as this design lends itself to promote accumulation of excrement and other unsanitary deposits while making the proper cleaning difficult. Furthermore, the drain platform design does not allow for partial submersion in a bath of warm water, thereby making bathing of an infant very uncomfortable and limiting the useful life of the product to a baby's diaper years.

It would be greatly advantageous to provide a more durable, convenient, sanitary, practical and safe baby changing, cleansing and bathing station that integrates with a conventional toilet, folds for storage above the toilet, and can be readily deployed by a single hand for use as a baby bidet or bathinette for safe, sanitary and convenient changing, cleansing or bathing of a baby.

SUMMARY OF THE INVENTION

It is, therefore, a primary object of the present invention to provide a functional, convenient, hygienic and stable fold-down baby changing, cleansing and bathing station that integrates with a conventional toilet, folds for storage above the toilet, and can be readily deployed using a single hand for changing, cleansing or bathing of a baby.

It is another object to provide a fold-down baby changing, cleansing and bathing station with shower wand that can be connected to conventional water plumbing fixtures and utilized for cleansing of a baby, and a fold-down drain that empties into the toilet for flushing afterward.

It is another object to provide a drip-free drain with integral disinfectant/deodorizer for an elevated over-toilet baby changing, cleansing and bathing station.

It is another object to provide a disposable drain tube lining for an easy and hygienic maintenance of the drip-free drain.

It is another object to provide a fold-down baby changing, cleansing and bathing station that reduces the number of used bacteria filled disposable wipes you have to dispose of and their-non biodegradable plastic packaging.

It is another object of the invention to provide a fold-down baby changing, cleansing and bathing station that folds for storage above the toilet into an aesthetically pleasing cabinet fixture.

It is another object of the invention to provide a fold-down baby changing, cleansing and bathing station that remains useful after a baby grows out of diapers.

According to the present invention, the above-described and other objects are accomplished by providing a baby changing, cleansing and bathing station, comprising a basin hinged at the rear to pivot away from the wall overtop an existing toilet, a shower wand with adapter for connection to an existing sink faucet or shower, a front leg assembly for automatically deploying upon pivoting down of the basin, and a fold-down drain for automatically deploying upon pivoting down of the basin to drain water from the basin into said toilet. The automatic leg(s) and drain allow for easy one-hand deployment while carrying a baby. The baby changing, cleansing and bathing station is adaptable to a freestanding configuration with either a cabinet enclosure or rear leg assembly for freestanding support, or a wall-mounted configuration with or without a cabinet enclosure.

A seat with anatomically shaped contours fitted or molded into the basin, and an integrated safety belt supports the baby at the rear, back and chest, thereby preventing sliding around while providing a safe and comfortable support.

A novel drip-catching sleeve is also provided for enveloping said fold-down drain when not deployed to prevent any residual dripping, and an absorbent antiseptic/deodorizing insert in said fold-down drain to absorb and disinfect any residual drippage in said sleeve while providing a pleasant scent.

The foregoing and other features to be described provide a durable, convenient, sanitary, practical and safe baby changing, cleansing and bathing station that integrates with a conventional toilet, folds for storage above the toilet, and can be readily deployed for changing, cleansing or bathing of a baby.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Figure 1:
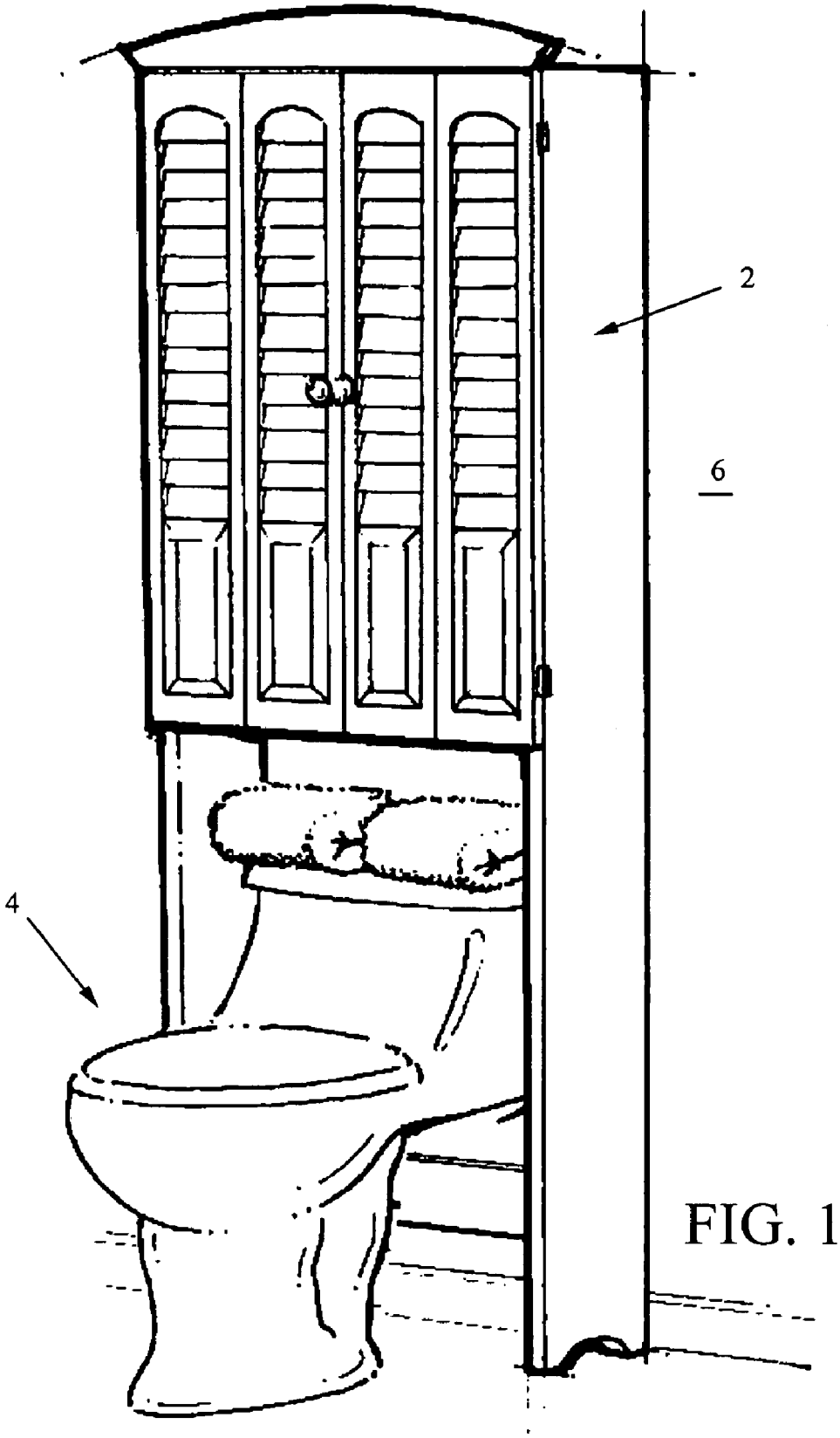
FIG. 1 is a perspective illustration of a freestanding baby changing, cleansing and bathing station stowed and fully concealed in integral cabinet enclosure 2 against a wall 6 and standing over a conventional toilet 4 according to the present invention.
Figure 2:
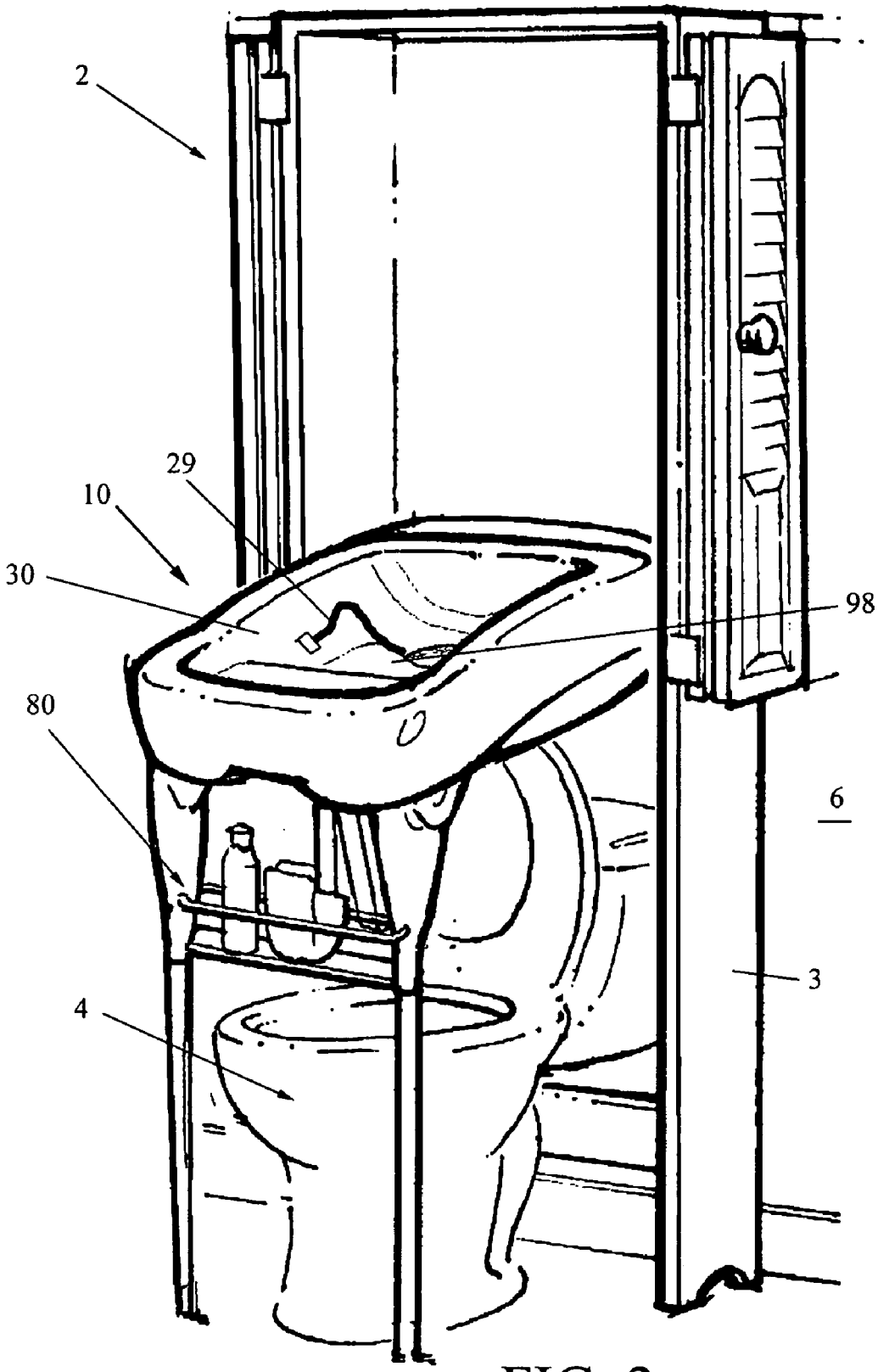
FIG. 2 is a perspective illustration of the freestanding baby changing, cleansing and bathing station 10 deployed for use from the integral cabinet enclosure 2 of FIG. 1.

FIGS. 1 and 2 are a perspective illustration of a freestanding baby changing, cleansing and bathing station 10 stowed and fully concealed (FIG. 1) in integral cabinet enclosure 2 against a wall 6 and standing over a conventional toilet 4, and deployed for use from the cabinet enclosure 2 (FIG. 2) according to the present invention. The baby changing, cleansing and bathing station 10 folds down over the conventional toilet 4, derives water from a nearby sink or shower fixture, and drains into the toilet 4 for changing, cleansing or bathing of a baby.

The baby changing, cleansing and bathing station 10 generally comprises a basin 20 with safety belt 29 and anatomically shaped seat 98 in the basin 20 to support the baby at the rear, back and chest, thereby preventing sliding around while providing a safe and comfortable support. In this embodiment the cabinet 2 is a freestanding unit formed from panels in a rectangular frame with elongate side panels 3 that form supporting legs. The basin 20 is hinged at the rear (inside cabinet 2) to fold away from the wall 6 overtop toilet 4. An upper section of the cabinet 2 is flanked by doors, for example, bi-fold louvered doors, which swing shut to form a closure. Side panels 3 support the rear of the basin 20 and straddle the toilet, and a pair of fold-down front legs 50A, 50B support the front of the basin 20. The legs 50A, 50B are joined by a utility shelf 80 which holds cleaning supplies and sundries. The fold-down sanitary drain 60 hangs down between the legs to drain the soiled water in basin 20 into the toilet. Both of the front legs 50A, 50B are pivotally mounted by over-center spring mounts (as will be described) to automatically pivot to the proper folded or extended position, depending on the vertical or horizontal position of basin 20, respectively. This allows for easy one-hand deployment while carrying the baby.

Figure 3:
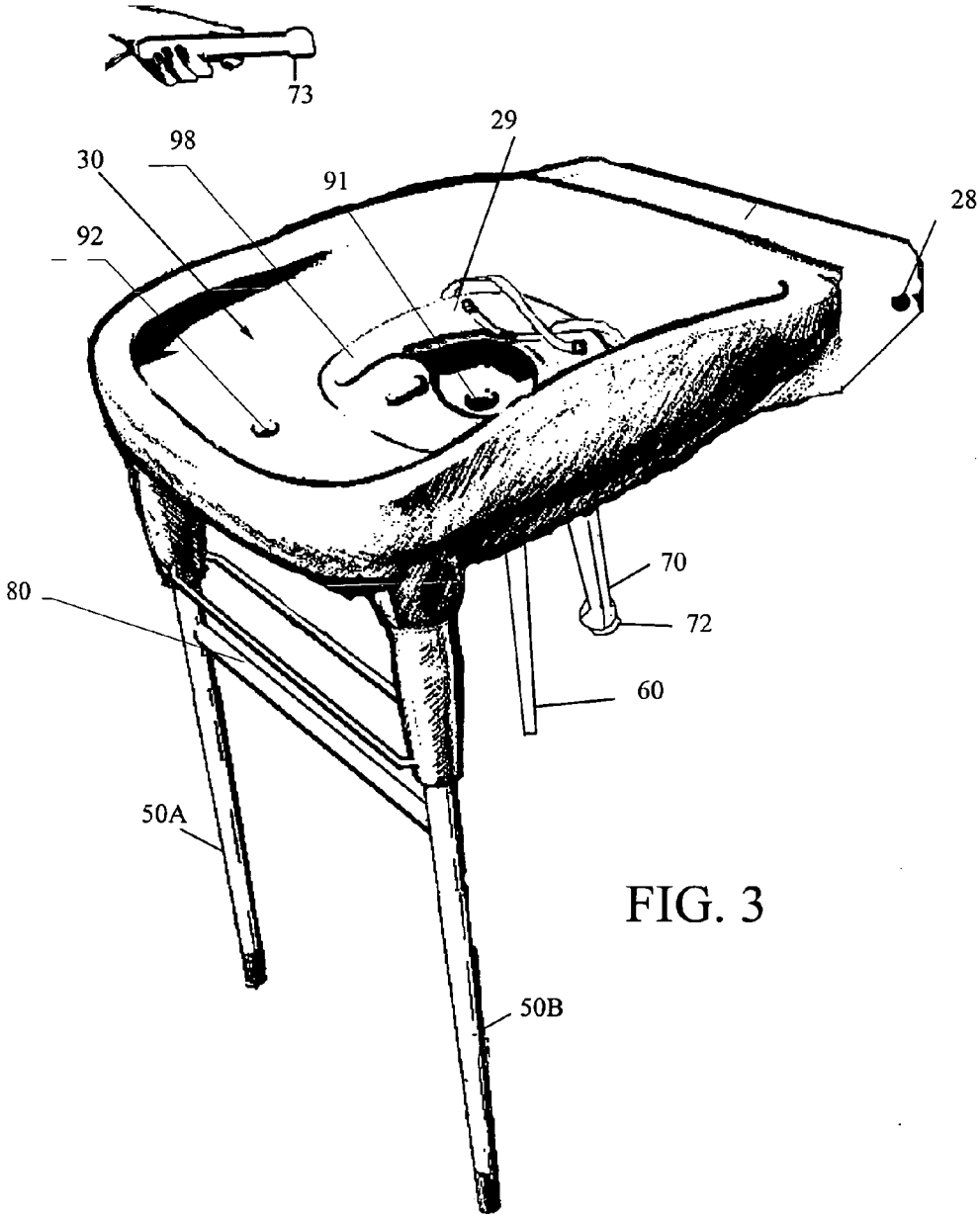
FIG. 3 is a perspective illustration of the baby changing, cleansing and bathing station 10 removed from the integral cabinet enclosure 2 of FIG. 2.

FIG. 3 is a perspective illustration of the baby changing, cleansing and bathing station 10 removed from the integral cabinet enclosure 2 of FIG. 2 which illustrates the interior of basin 20 including contoured seat 98, and the drainage system including dual drains 91, 92 which lead into the fold-down sanitary drain 60. A mini-shower wand 73 provides an adjustable flow shower with fresh running water. The shower wand 73 has on/off control. The shower wand 73 is equipped with flexible hose terminated by a conventional faucet or shower adapter for easy attachment to most bathroom sink faucets or showers. The adapter easily connects to an existing faucet by replacing the existing aerator with the adapter (or likewise to the shower head). The adapter is equipped with a diverter valve which allows dual use of the sink/shower, or alternatively, the shower wand.

The basin 20 may be integrally blow-molded, rotationally-molded or otherwise molded from plastic, preferably FDA approved high-impact polyethylene to resist fungal and bacterial growth. The anatomically shaped comfort seat 98 may be integrally formed therewith, but is more desirable to be removable for cleaning. The basin 20 is pivotally attached in the cabinet enclosure 2 by pins or axels at pivot points 28, by which it is removed from the integral cabinet enclosure 2.

Figure 4:
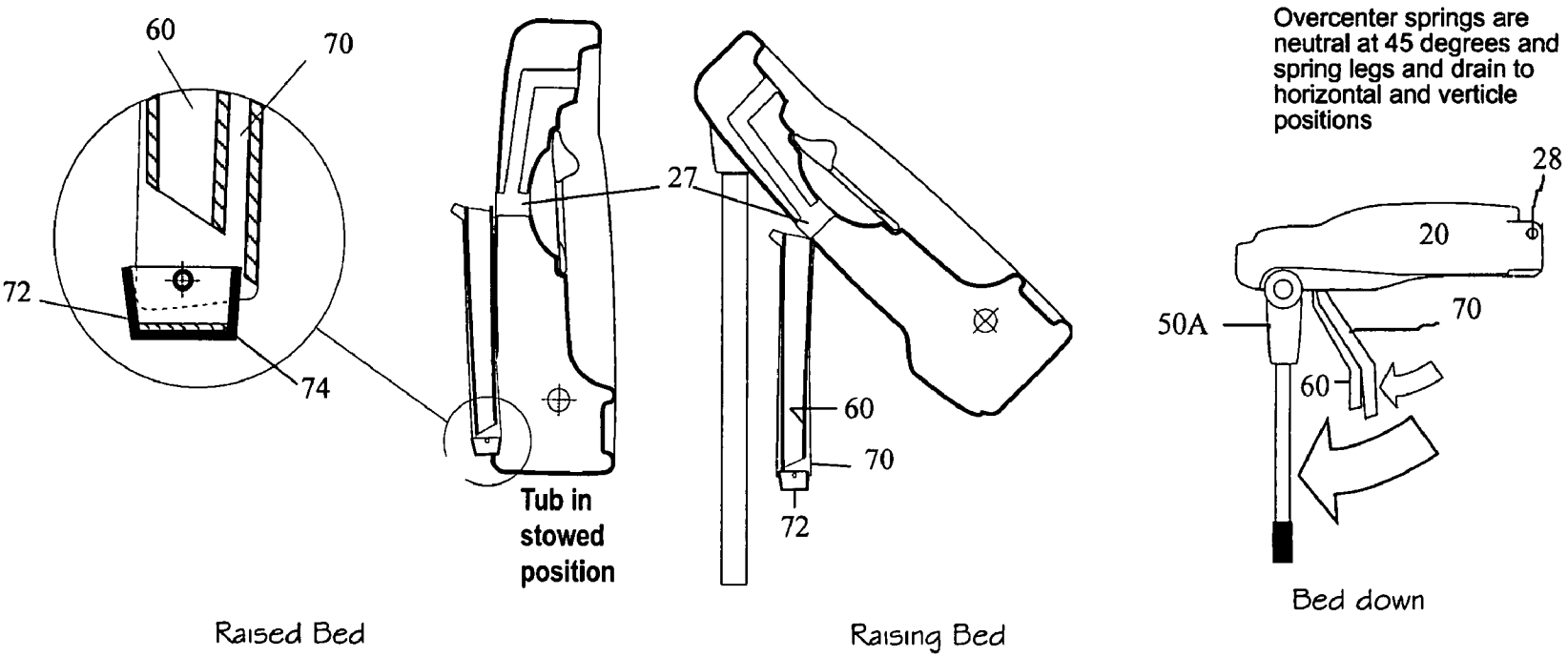
FIG. 4 is a sequential diagram illustrating operation of the pair of fold-down front legs 50A, 50B and fold-down drainage system.

FIG. 4 is a sequential diagram illustrating operation of the pair of fold-down front legs 50A, 50B and fold-down sanitary drain 60. There is a significant need for one-hand operation of the baby changing, cleansing and bathing station 10 due to the other hand usually carrying a baby. For this reason, prior art devices typically refrain from using front legs because they need to be unfolded with a second hand. Thus, for example, the '186 patent to Ayers (described above) bears the entire load of the cabinet, basin and baby at the pivot-joints, and the device is prone to wobbling, pulling out the support arms or otherwise breaking. The present invention offers a safer solution in the form of solid freestanding support with cabinet panels 3 (as seen in FIGS. 2 & 3) serving as legs, and automatically folding front legs 50A & 50B.

The combination of automatically folding front legs 50A & 50B with stable rear support (by cabinet panels 3 or otherwise as will be described) gives a slip-resistant footing and provides as safe and slip-free a foundation as possible for the baby. The free standing design of FIGS. 1 & 2 and heavy-duty construction will accommodate a child throughout the diapering years and, indeed, is rated to 300 lbs of static load.

For convenience, both of the front legs 50A, 50B as well as the drain 60 are pivotally mounted by over-center spring mounts (as will be described) to automatically pivot to the proper folded or extended position, depending on the vertical or horizontal position of basin 20, respectively. As seen in FIGS. 4A-C, front legs 50A, 50B and drain 60 automatically fold down as the basin 20 is pulled down around pivot points 28 (away from the wall), and automatically fold up as the basin 20 is pushed up around pivot points 28 (toward the wall). This allows for convenient one-hand operation.

FIG. 4 is a composite drawing illustrating the configuration and operation of drain 60 and legs 50A & 50B. The drain 60 is a tubular member pivoted to the underside of the basin 20, and when deployed it swings into communication with an outlet 27 through the basin 20. This allows it to hang vertically and drain directly into the toilet. When in the stowed position (FIGS. 4A & B), the drain 60 remains nested in a drip catcher sleeve 70, which has a drip basin 72 pivotally mounted beneath it. The drip catcher sleeve 70 is a trough that partially encloses the drain 60 and runs down into drip basin 72. Drip catcher sleeve 70 is similarly pivoted to the basin 20 and deploys along with drain 60, swinging downward with it until it is almost fully deployed. The drip catcher sleeve 70 and drip basin 72 catch any runoff from the drain and ensures that none escapes. Additionally, the drip basin 72 may be loaded with a disposable deodorizer/disinfectant 74 in replaceable packet form which absorbs the runoff and eradicates odors to ensure completely sanitary conditions.

FIG. 4A is the fully stowed position of basin 20 with front legs 50A, 50B and drain 60 protruding downward. FIG. 4B shows the basin 20 at 45 degrees with front legs 50A, 50B and drain 60 still protruding downward. The drip catcher sleeve 70 is formed with a protruding stop member 71 (as will be described) which eventually contacts the underside of basin 20, thereby preventing further swing and separating the drain 60 from the drip catcher sleeve 70. Whereas the drain 60 continues its arc outward to a fully extended position (see FIG. 4C), the drip catcher sleeve 70 stops and allows drain 60 to swing clear. Conversely, upon stowing the unit, the drip catcher sleeve 70 again joins the drain 60 and envelops it to prevent drippage, both components 60, 70 swinging upward together.

Figure 5:
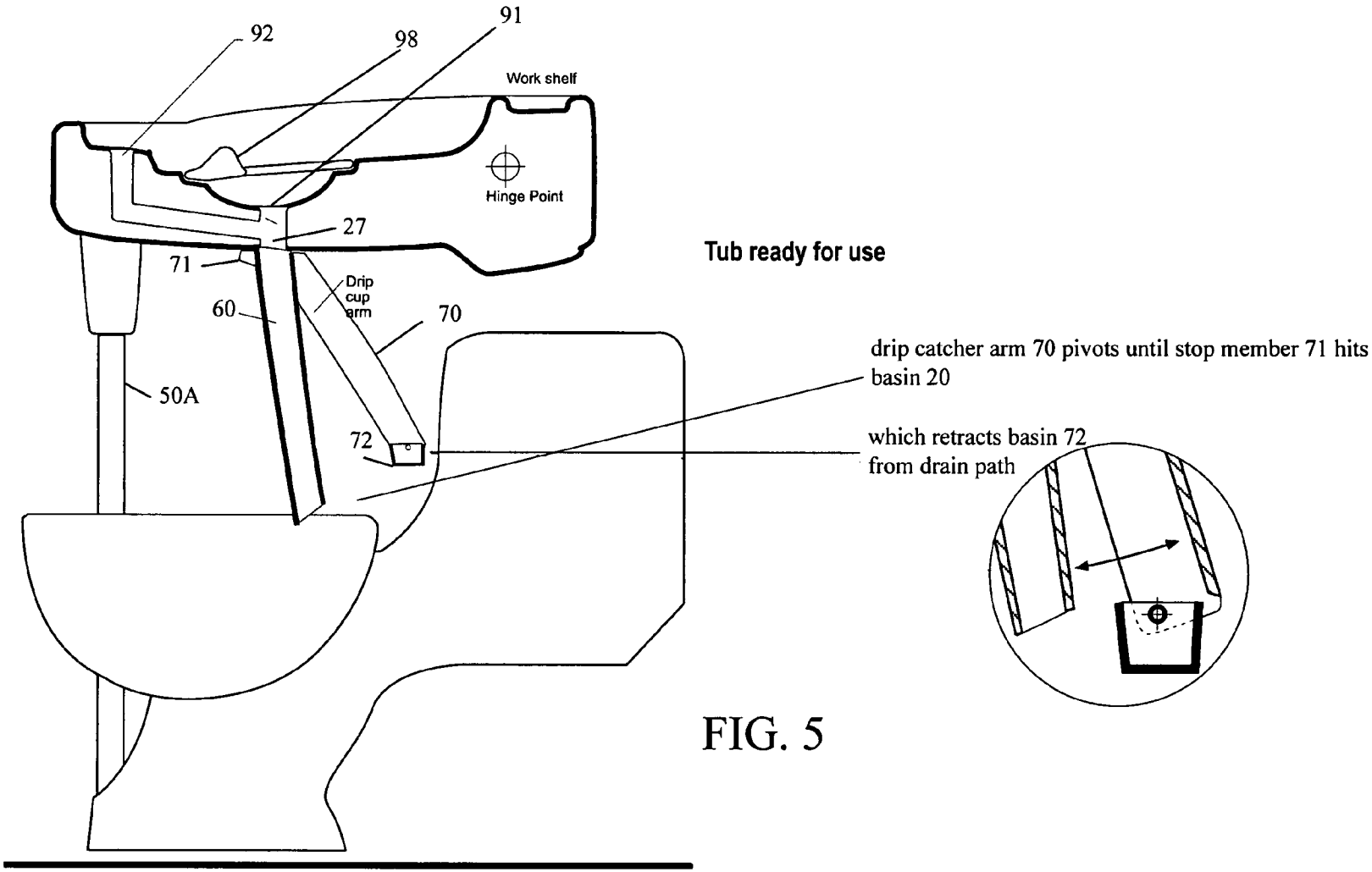
FIG. 5 is a cross-section drawing illustrating the drainage system in more detail.

FIG. 5 is a cross-section drawing illustrating the drainage system in more detail with basin 20 in its deployed position (as in FIG. 4C). The drain 60 is pivoted downward from the underside of the basin 20 in direct communication with an outlet 27 through the basin 20. The outlet continues upward to a branch where it diverges to a main drain 91 at the bottom center of the basin 20, and to a supplemental drain 92 elevated toward the brim of basin 20 to prevent overfilling. The drip catcher sleeve 70 (with distal drip basin 72) is likewise pivoted to the underside of the basin 20 and deploys along with drain 60, swinging downward with it until it is almost fully deployed. However, drip catcher sleeve 70 is formed with a protruding lever arm 71 that eventually contacts the bottom of basin 20, thereby preventing further pivoting and separating the drip catcher sleeve 70 from the drain 60. Consequently, as the drain 60 continues pivoting to a fully vertical position (shown), the drip catcher sleeve 70 eventually stops (as the lever arm 71 catches). The drip catcher sleeve 70 is urged rearwardly out of the way, and the drain 60 pivots clear. Conversely, upon stowing the unit, the drip catcher sleeve 70 again joins the drain 60 and envelops it to prevent drippage, both components 60, 70 swinging upward together. Again, the drip basin 72 may be loaded with a disposable deodorizer/disinfectant in replaceable packet form to absorb seepage, eradicate odors and ensure completely sanitary conditions.

For convenience, the front legs 50A, 50B are pivotally mounted by over-center spring mounts (as will be described) to automatically pivot to the proper folded or extended position, depending on the vertical or horizontal position of basin 20, respectively. The drain 60 pivots by gravity.

Figure 6:
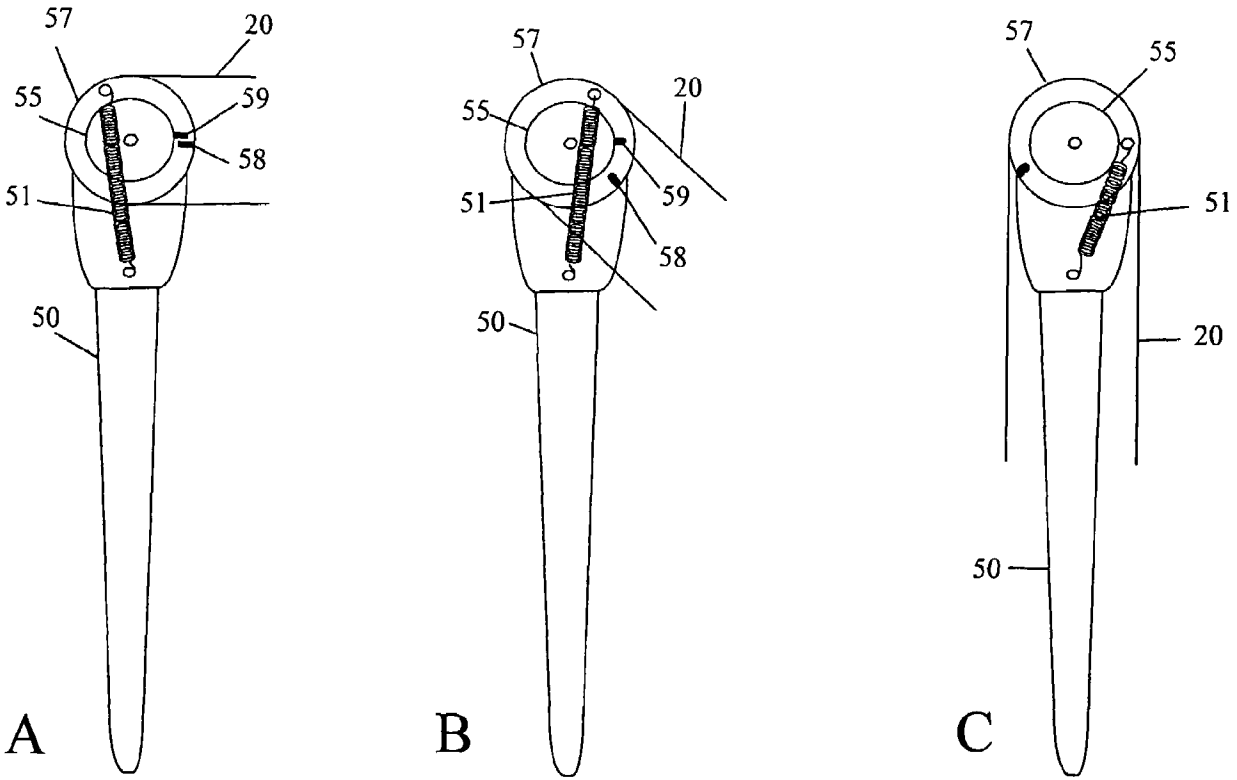
FIG. 6 is a sequential diagram illustrating the over-center joint for fold-down front legs 50A, 50B which accomplishes the action of FIG. 4.

FIGS. 6A-C collectively illustrate the over-center joint which accomplishes pivoting of front legs 50A, 50B. The over-center joint generally comprises opposing coaxial hubs 55, 57 pivotally joined together, hub 55 being fixedly attached to the leg 50 and hub 57 being attached to the basin 20. In addition, an over-center spring 51 is extended from the hub 57 of basin 20 to the hub 55 of leg 50 to bias the leg 50 into either the closed position of FIG. 6C (if the basin 20 is vertical), the open position of FIG. 6A (if the basin 20 is horizontal), or the neutral position of FIG. 6B (at 45 degrees). This form of joint is employed at both the front legs 50A, 50B and may also be used to facilitate one-hand operation, and to avoid loose dangling of parts. The hub 55 is preferably formed with an internal stop 59 that cooperates with a stop 58 in hub 57 to limit the extension of legs 50A & 50B to a 90 degree angle from basin 20 as shown.

Figure 7:
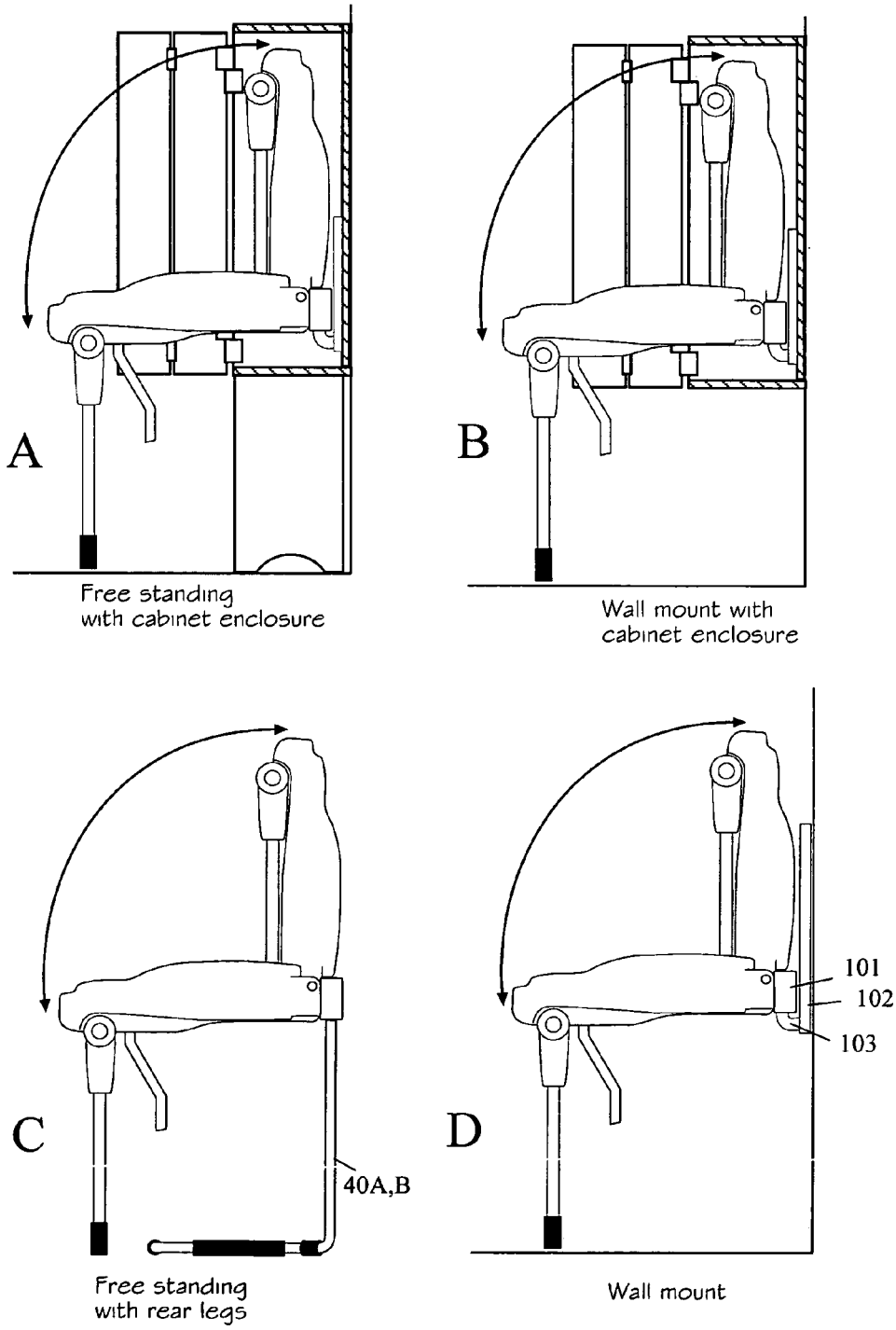
FIG. 7 is a composite drawing illustrating four alternate mounting configurations for baby changing, cleansing and bathing station 10.

FIG. 7 is a composite drawing illustrating how the baby changing, cleansing and bathing station 10 is adaptable to a freestanding configuration with either a cabinet enclosure (FIG. 7A) as shown in FIGS. 1 & 2, or alternatively, a rear leg assembly (FIG. 7C) for freestanding support. Moreover, station 10 may be adapted to a wall-mounted configuration with a cabinet enclosure (FIG. 7B) or without cabinet (FIG. 7D).

Rather than relying on the cabinet 2 for rear support, the embodiment of FIG. 7C relies on a pair of pivotally-mounted rear legs 40A, 40B that straddle the toilet. Like the front legs 50A, 50B, the rear legs may be formed of tubular stock. Rear legs 40A, 40B are preferably bent to form a stable supporting base against the floor. Either of the wall-mounted configurations of FIG. 7B or FIG. 7D rely on the wall for support (not freestanding), the cabinet 2 of FIG. 7B being secured to the wall and the basin 20 pivotally mounted inside the cabinet 2. The wall-mounted configuration without cabinet enclosure (FIG. 7D) requires a wall-mounting assembly which may be a pair of collars 101 each pivotally attached to the basin 20. Struts 103 are inserted into the respective collar 101 and extend toward the wall, coupling into brackets 102 that are secured to the wall. This may form a fixed wall-mounting or adjustable by forming brackets 102 in a pegboard configuration.

Figure 8:
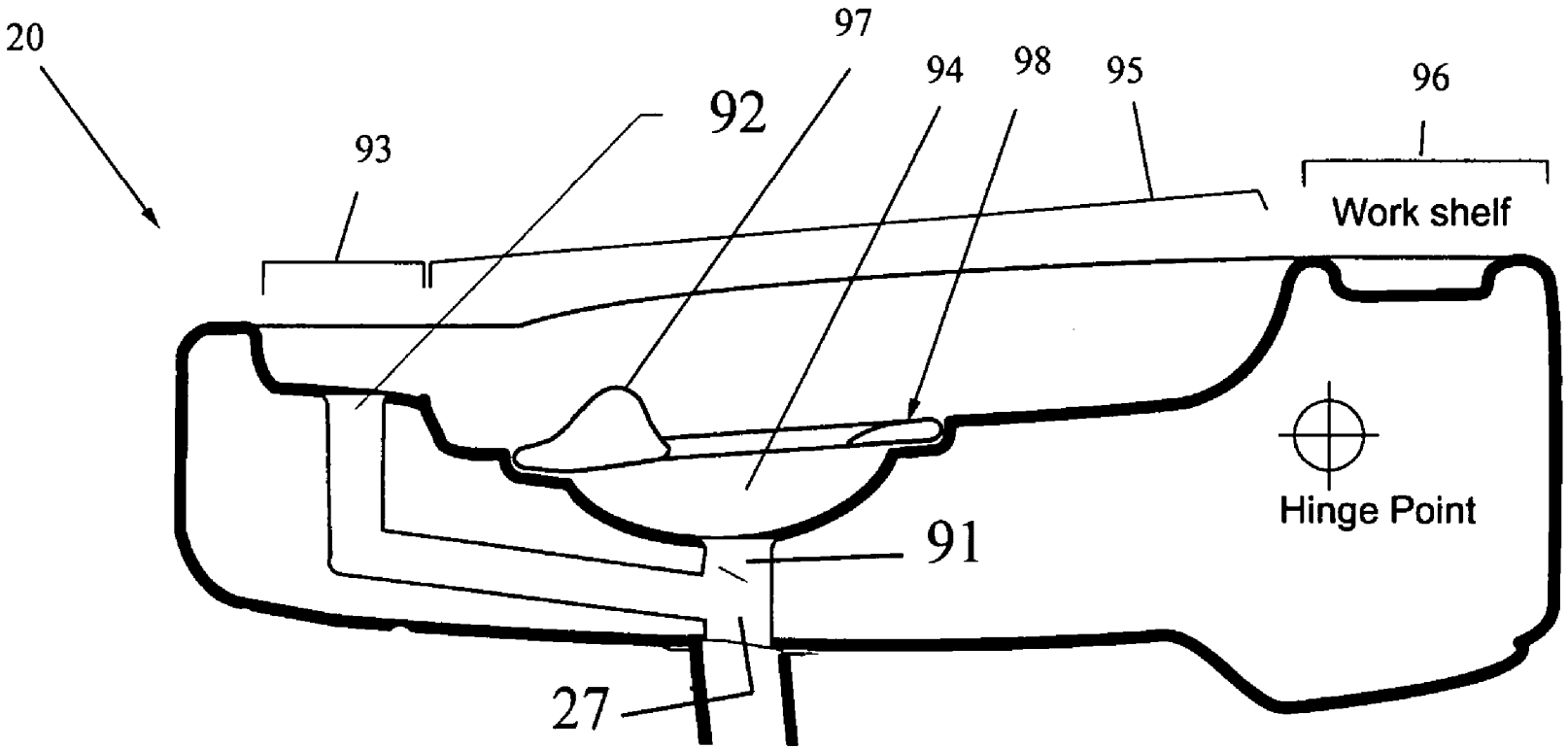
FIG. 8 is a side cross-section of the seat with anatomically shaped contours fitted into the basin 20.

FIG. 8 is a side perspective view of the interior of basin 20 which shows the anatomical seat 98 with shaped contours fitted into the basin 20. The basin 20 is formed with a tiered recess including a collection basin 94 with central drain 91, the collection basin 94 being ringed by a slight recess for seating and centering seat 98, plus a main recess 95 with upwardly curved sides and back for bathing. In addition, a forward raised drainage shelf 93 empties into a secondary drain 92 to prevent overfilling. The seat 98 which is centered over the collection basin 94 is a anatomically conforming ring similar to a baby toilet trainer seat, with a pronounced crotch 97 for stabilizing the baby. The seat 98 may be further ornamented or embellished (such as shaped as a character) as increase the play value of the unit. However, the functional contours of the main recess 95 and seat 98 are anatomically designed to conform to the back of a baby and the rear of main recess 95 is angled upwardly inclined toward the head to lift, support and stabilize the baby during cleansing. Thus, the main recess 95 and seat 98 support the baby at the bottom and back, thereby stabilizing the baby from side-to-side and preventing sliding down while providing a safe and comfortable support. In addition, referring back to FIG. 2, a child-restraining safety belt 29 maintains the baby on the seat 98 and insures against falling off.

In operation of the foregoing embodiments, the basin 20 is pivoted downward until supported by the front legs 50A & 50B that bear the weight and are locked in place with drain 60 directed into the toilet bowl. The infant is placed on the seat 98 in basin 20 and is protected from falling by the safety belt 29. The child may be cleaned by sponging (a sponge and other cleaning articles are kept in the workshelf 80), or by means of the spray wand 70 which is attached to a faucet or shower. The dirty water will pass into drainage basin 94 and out through drain 91 and outlet 27 down through the drain 60 without re-circulating or contaminating the child. This water is drained into the toilet bowl by the drain 60. After the child is quickly and safely cleaned and dried, he can be removed to a safe area, and the entire assembly is expeditiously cleaned by spray wand 70. The toilet is flushed, and the entire assembly is folded upward over the toilet so that the toilet may be used normally.

Figure 9:
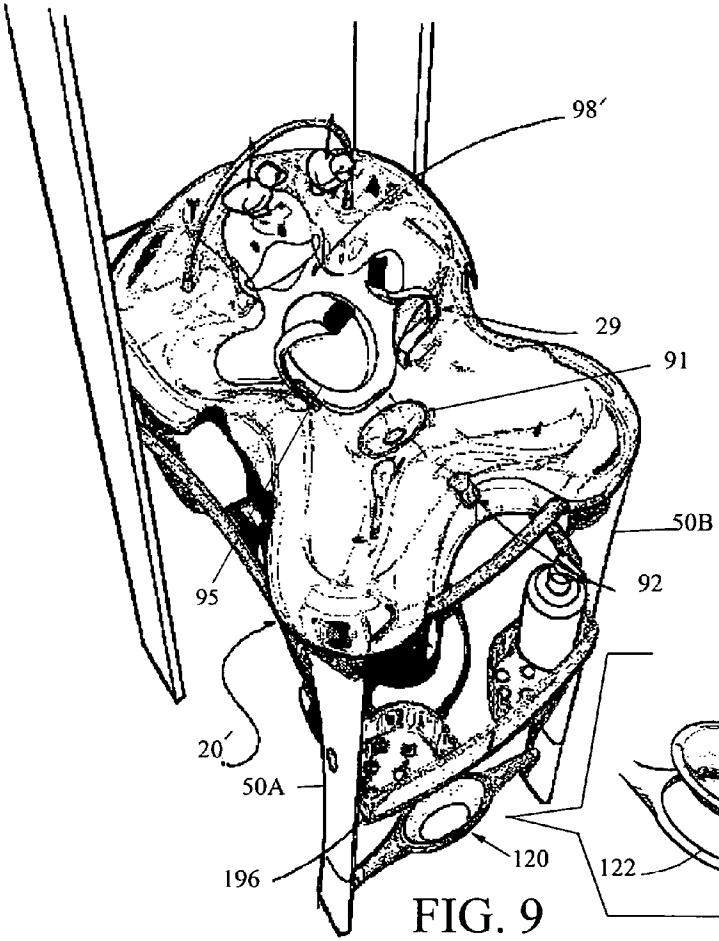
FIG. 9 is an overhead perspective view of a baby changing, cleansing and bathing station 100 according to another embodiment of the present invention.

FIG. 9 is an overhead perspective view of a baby changing, cleansing and bathing station 100 according to yet another embodiment of the present invention, shown in a freestanding configuration, with like parts being represented with like reference numerals per above. Here the upwardly curved sides and back of the main recess 95' and seat 98' are shown padded in the outward form of a duck to increase play value and provide soft and comfortable back and head support. A workshelf 196 is suspended between the legs 50A & 50B for retaining sponges, shampoos, soaps and the like. There are three primary differences in embodiment 100, the first being the use of a support frame 130 beneath a detachable basin 20'.

Figure 10:
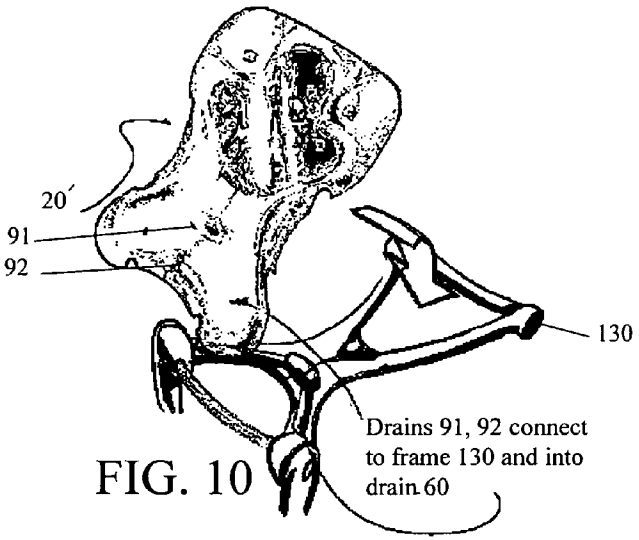
FIG. 10 is a partially exploded view of the baby changing, cleansing and bathing station 100 as in FIG. 9.

FIG. 10 is a partially exploded view of the baby changing, cleansing and bathing station 100 as in FIG. 9. The support frame 130 is a hollow tubular structure which cradles the basin 20'. This configuration facilitates easier removal and cleaning of basin 20'. The pivoting drain system 60 and legs 50A & 50B as previously described are pivotally connected to the frame 130 rather than directly to basin 20', and drains 91, 92 of basin 20' are coupled into a pass-through conduit in the frame 130 for drainage into the drain system 60.

The other difference is a modified drip tray 120 that substitutes for the above-described drip catcher sleeve 70 and drip basin 72. The drip tray 120 comprises a supporting bracket 122 suspended between the legs 50A & 50B, and a drip cup 124 removably inserted into the bracket 122. When the unit 100 is deployed as shown, the drip tray 120 does not impose. However, when the unit 100 is stowed the drip tray 120 centers itself beneath the drain 60 to catch drippage.

Also shown is a locking/unlocking mechanism to ensure the proper deployment of front legs 50A and 50B and further act as a lock to hold said legs in place and prevent them from being accidentally kicked-in. When unit is stowed inside storage cabinet, this ensures that all the moving parts travel to the precise desired position.

Figure 11:
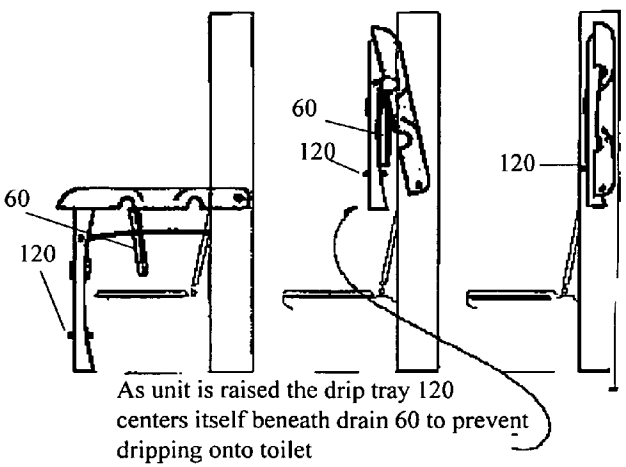
FIG. 11 is a sequential view of the operation of the baby changing, cleansing and bathing station 100 as in FIGS. 9 & 10.

FIG. 11 is a sequential view of the operation of the baby changing, cleansing and bathing station 100, showing the operation of the drip tray 120. As the unit 100 is pivoted upward toward the stowed position, the drip tray 120 stays upright and moves beneath the dangling drain 60, eventually centering itself therebeneath when the unit 100 is fully stowed against the wall to catch drippage running down the drain 60.

Figure 12:
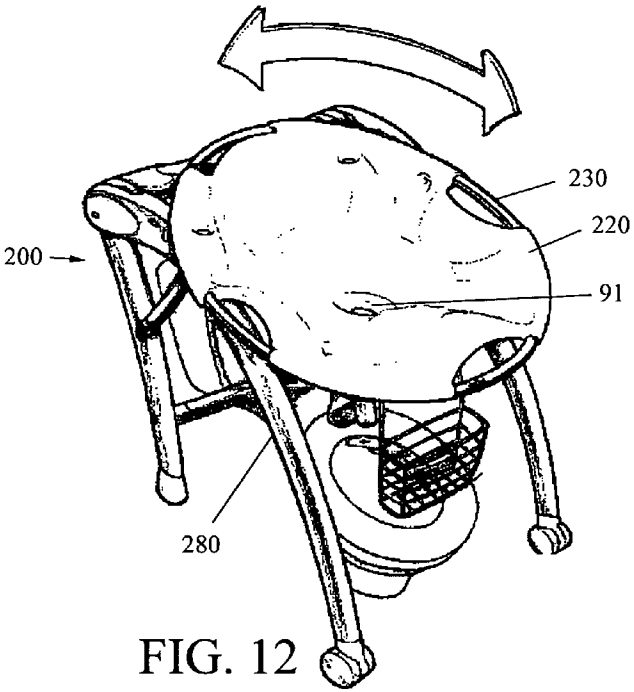
FIG. 12 is a perspective view of another freestanding embodiment 200 of the present invention.

FIG. 12 is a perspective view of another alternative embodiment 200 of the present invention, which is a portable freestanding configuration for whenever a permanent installation is undesirable. The unit 200 includes an oval basin 220 reinforced by a peripheral ring 230. The basin 220 is rotationally supported by a pivot assembly (as will be described) to allow full 360 degree rotational positioning. The basin 220 and pivot assembly are mounted on a folding leg assembly 280 which folds flat to allow space-saving storage of the unit 200.

Figure 13:
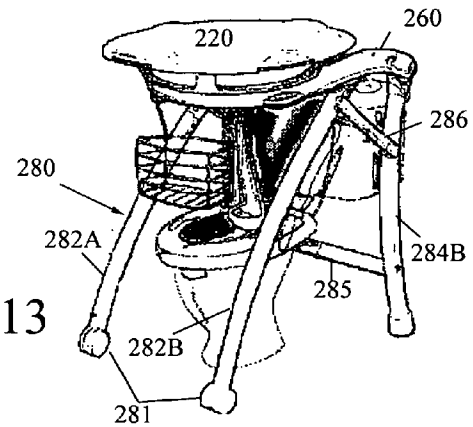
FIG. 13 is an exploded view of the seat cushion 98, basin 220, ring 230 and pivot assembly as in FIG. 12.

FIGS. 13 is an exploded view of the seat 98, basin 220, ring 230 and pivot assembly. The contoured seat 98 (as described above) is inserted into the molded basin 220, the basin 220 being reinforced by peripheral ring 230 and preferably having a plurality of peripheral recesses as shown so that the ring 230 serves as a handle. Ring 230 is preferably a circular section of hollow tube. The pivot assembly comprises a bracket 240 with upwardly raised arms for gripping the ring 230, and a series of semi-circular notches formed in the base to allow rotation. The bracket 240 is seated atop a support frame 260 which connects to the folding legs assembly 280. The support frame 260 includes a plurality of slip posts 250 which protrude upward through the notches in bracket 240 to capture it there atop, and yet to allow rotation of the bracket 240 relative to frame 260 along notches for rotational positioning. A like drip catcher sleeve 70 and drain 60 pivot downward from support frame 260 as described above. The support frame 260 is mounted on a folding leg assembly 280 which folds flat to allow space-saving storage of the unit 200.

Figure 14:
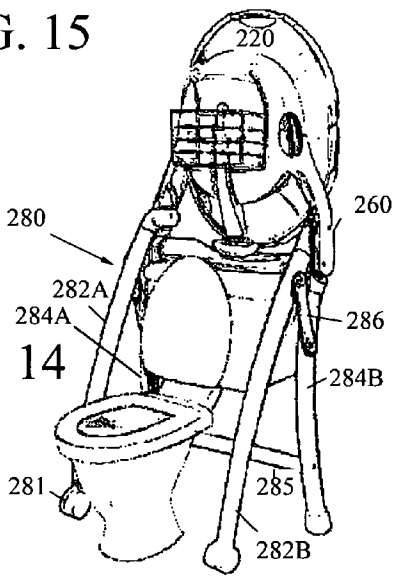
FIGS. 14 and 15 are sequential views of the freestanding embodiment 200 of FIG. 12 which illustrate the folding leg assembly 280 in the unfolded deployed position (FIG. 14) and folded flat (FIG. 15) for storage.
Figure 15:
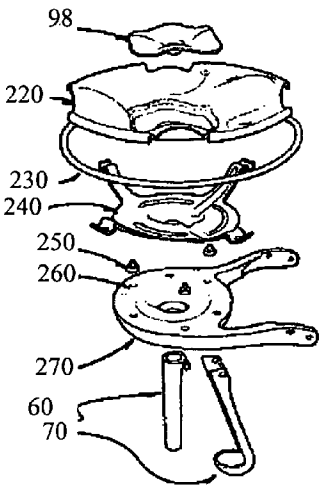

FIGS. 13 and 14 are sequential views of the unit 200 which illustrate the folding leg assembly 280 in the unfolded deployed position (FIG. 13) and folded flat (FIG. 14) for storage. As seen in FIG. 13 the leg assembly 280 comprises a pair of front legs 282A & 282B with distal castors 281. The front legs 282A & 282B arch upward and are pivotally joined to support frame 260 as described above. Similarly, a pair of rear legs 284A & 284B are pivotally joined to support frame 260 as shown. A reinforcing bracket 285 joins rear legs 284A & 284B for reinforcement and stability. In addition, a pair of struts 286 are pivotally mounted between each rear leg 284A (here obscured) & 284B and corresponding front leg 282A & 282B as shown to compel self-folding to the position shown in FIG. 14. The embodiment 200 as shown in FIGS. 12-15 is much more suited for daycare centers or the like where a permanent installation is undesirable.

One skilled in the art will also understand that one or more components of the drain assembly may be provided as a disposable to avoid the need for cleaning. For example, the drain 60 may be partially formed as disposable paper sleeve.

Figure 16:
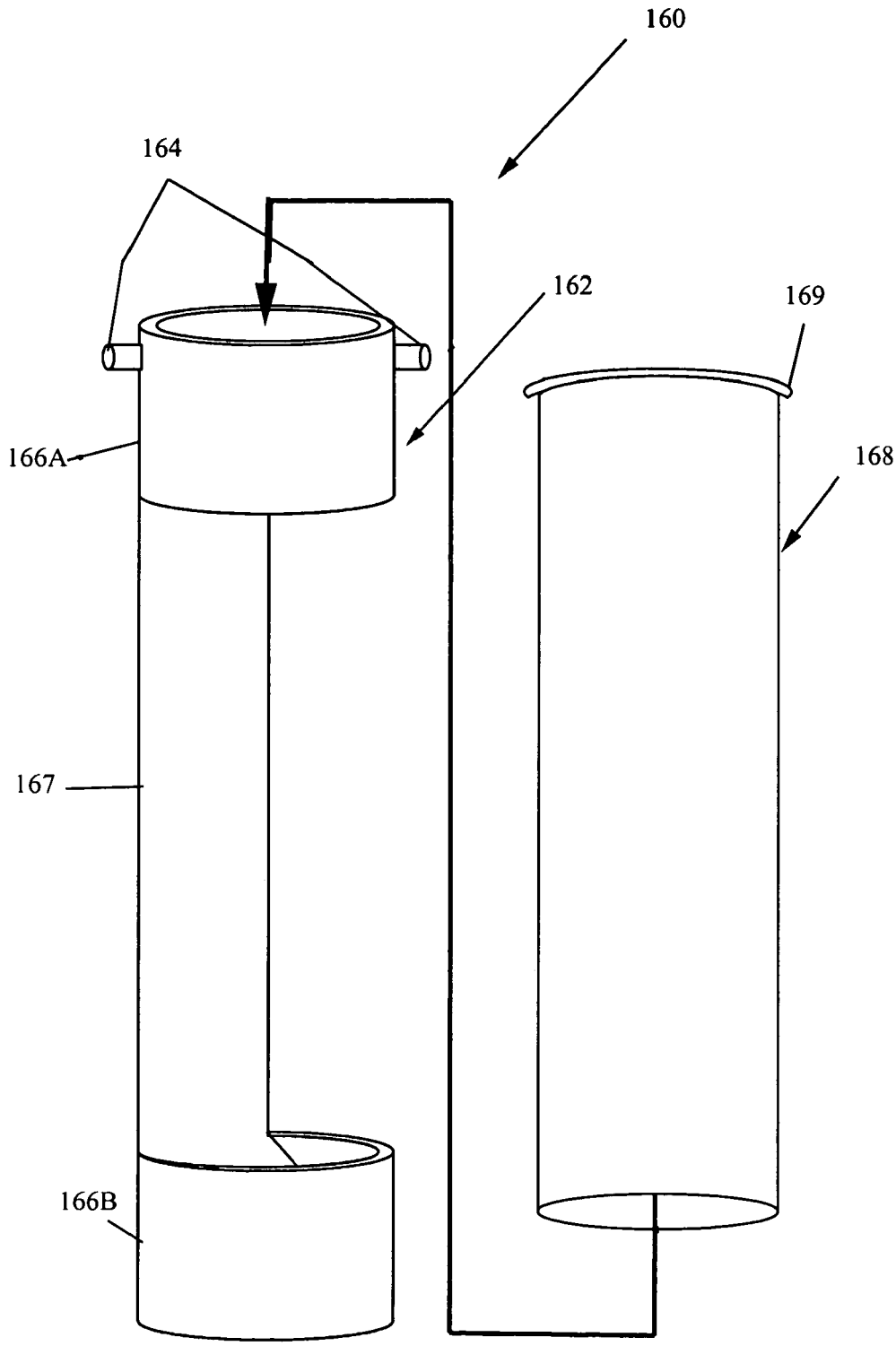
FIG. 16 is an exemplary embodiment of a drain 160 with disposable insert 168.

FIG. 16 is an exemplary embodiment of a drain 160 with disposable insert 168. A tubular frame 162 includes a pair of reinforcing collar 166A & 166B joined by a half-pipe 167. The collars 166A & 166B and half-pipe 167 may be one integrally-molded plastic part. A pair of pivot pins 164 protrude from the upper collar 166A by which the drain 160 can be attached there beneath, pins 164 snapping into yoke-sockets on the underside of basin 20 allowing the frame 162 to dangle. The frame 162 serves as a guide for insertion of a tubular paper disposable sleeve 168 formed of paper having a high level of wet strength and very low porosity designed for multiple uses, and yet biodegradable, cheap and flushable. The paper sleeve 168 has a rolled collar 169 to limit insertion into frame 162 as shown. The paper sleeve 168 when its useful life is spent, can be replaced and flushed down the drain. The half-pipe 167 of frame 162 retains paper sleeve 168 and also provides a flow path into the toilet in case the paper sleeve 168 unintentionally ruptures.

The above-described changing, cleansing and bathing station in all illustrated embodiments and with all described variations vastly simplifies cleansing of a baby, and yet folds for storage above the toilet into an aesthetically pleasing way.

Having described the present invention, in detail it will be appreciated that variations in the materials and construction may be incorporated without departing from the inventive concept presented herein. For example, rather than the over-center spring mechanism described in FIGS. 6A-C, the same objectives may be achieved with a simple bar linkage mechanism that engages the legs. These and other minor variations are considered to be within the scope and spirit of the appended claims.

We claim:

1. A baby changing, cleansing and bathing station, comprising:

a basin hinged at the rear overtop an existing toilet to pivot away from a wall behind said toilet from a vertical stowed position to a horizontal deployed position;

a fold-down front leg assembly pivotally attached at one end to said basin for maintaining said front leg assembly in a vertical hanging position as said basin is pivoted down from vertical toward horizontal thereby automatically deploying said leg assembly to engage a floor and prevent further pivoting down of said basin;

a fold-down drain pivotally attached at one end to said basin for maintaining a downwardly-directed orientation as said basin is pivoted down from vertical toward horizontal thereby automatically deploying over said existing toilet to drain water from said basin into said toilet;

whereby said automatic leg assembly and drain allow for easy one-hand deployment while carrying a baby.

2. The baby changing, cleansing and bathing station according to claim 1, further comprising an anatomically conforming seat insertable into said basin.

3. The baby changing, cleansing and bathing station according to claim 2, wherein said comfort seat comprises a protruding crotch pad.

4. The baby changing, cleansing and bathing station according to claim 1, further comprising a shower wand adapted for connection to an existing faucet or shower fixtures.

5. The baby changing, cleansing and bathing station according to claim 1, further comprising a rear leg assembly for freestanding support.

6. The baby changing, cleansing and bathing station according to claim 1, further comprising a floor-standing cabinet for freestanding support.

7. The baby changing, cleansing and bathing station according to claim 6, wherein said cabinet includes a removable enclosure for housing said basin when pivoted upwardly and stowed therein.

8. The baby changing, cleansing and bathing station according to claim 7, wherein said cabinet includes a pair of doors flanking said enclosure for concealing the stowed basin.

9. The baby changing, cleansing and bathing station according to claim 1, further comprising a safety seat belt.

10. The baby changing, cleansing and bathing station according to claim 1, further comprising one from among the group consisting of a cabinet enclosure and rear leg assembly for freestanding support.

11. The baby changing, cleansing and bathing station according to claim 1, further comprising a wall-mounted bracket for pivotal support of said basin.

12. The baby changing, cleansing and bathing station according to claim 1, further comprising a wall-mounted cabinet for pivotal support of said basin.

13. A baby changing, cleansing and bathing station, comprising:

a basin hinged at the rear overtop an existing toilet to pivot away from a wall behind said toilet;

a fold-down front leg assembly for automatically deploying upon pivoting down of said basin;

a fold-down drain for automatically deploying upon pivoting down of said basin to drain water from said basin into said toilet; and a dripcatching sleeve for enveloping said fold-down drain when not deployed to prevent residual dripping;

whereby said automatic leg assembly and drain allow for easy one-hand deployment while carrying a baby.

14. The baby changing, cleansing and bathing station according to claim 13, wherein said dripcatching sleeve further comprises an absorbent antiseptic/deodorizing insert to absorb and disinfect any residual drippage in said sleeve and to eradicate odors.

15. The baby changing, cleansing and bathing station according to claim 13, further comprising a drip cup pivotally mounted on said dripcatching sleeve to collect residual dripping.

16. The baby changing, cleansing and bathing station according to claim 15, further comprising a disposable deodorizer/disinfectant packet inserted into said drip cup.

17. A baby changing, cleansing and bathing station, comprising:

a basin hinged at the rear overtop an existing toilet to pivot away from a wall behind said toilet;

a fold-down front leg assembly for automatically deploying upon pivoting down of said basin, said fold-down front leg assembly being pivotally attached to said basin by a pair of over-center springs attached between said legs and basin to bias said legs for automatically deployment upon pivoting of said basin; and a fold-down drain for automatically deploying upon pivoting down of said basin to drain water from said basin into said toilet.

18. A baby changing, cleansing and bathing station, comprising:

a basin hinged at the rear overtop an existing toilet to pivot away from a wall behind said toilet;

a fold-down front leg assembly for automatically deploying upon pivoting down of said basin;

a fold-down drain for automatically deploying upon pivoting down of said basin to drain water from said basin into said toilet, said drain being pivotally attached to said basin by an over-center spring attached between said drain and basin to bias said drain for automatically deployment upon pivoting of said basin.

19. A baby changing, cleansing and bathing station comprising:

a fold-down basin hinged at the rear overtop an existing toilet to pivot into a horizontal position above said toilet;

a fold-down front leg assembly for deploying upon pivoting down of said basin;

a fold-down drain for deploying upon pivoting down of said basin to drain water from said basin into said toilet; and means for preventing residual dripping from said drain when said basin and drain are folded up in a stowed position, wherein said fold-down drain comprises a disposable lining insertable into said drain for improved hygiene and ease of cleaning.

20. The baby changing, cleansing and bathing station according to claim 19, wherein said residual drip catching means further comprises a drip catch basin suspended between said fold-down legs.

21. The baby changing, cleansing and bathing station according to claim 19, further comprising a floor-standing cabinet for freestanding support.

22. The baby changing, cleansing and bathing station according to claim 19, wherein said disposable lining is made biodegradable and flushable.

* * * * *